US010228101B2

(12) United States Patent
Beausoleil

(10) Patent No.: US 10,228,101 B2
(45) Date of Patent: Mar. 12, 2019

(54) LED LIGHT FIXTURES AND LED LAMPS THAT ARE USED TO REPLACE PAR 36 HALOGEN LAMPS AND INCANDESCENT WELL LIGHTS

(71) Applicant: Mind Head LLC, Ridgewood, NJ (US)

(72) Inventor: David M. Beausoleil, Ridgewood, NJ (US)

( * ) Notice: Subject to any disclaimer, the term of this patent is extended or adjusted under 35 U.S.C. 154(b) by 266 days.

(21) Appl. No.: 15/201,154

(22) Filed: Jul. 1, 2016

(65) Prior Publication Data

US 2017/0002984 A1 Jan. 5, 2017

Related U.S. Application Data

(60) Provisional application No. 62/187,384, filed on Jul. 1, 2015.

(51) Int. Cl.

| | |
|---|---|
| ***F21V 11/00*** | (2015.01) |
| ***F21S 8/02*** | (2006.01) |
| ***F21V 23/00*** | (2015.01) |
| ***F21K 9/238*** | (2016.01) |
| *F21Y 115/10* | (2016.01) |
| *F21V 31/04* | (2006.01) |
| *F21W 131/109* | (2006.01) |

(52) U.S. Cl.

CPC ..... *F21S 8/022* (2013.01); *F21K 9/238* (2016.08); *F21V 11/00* (2013.01); *F21V 23/006* (2013.01); *F21V 31/04* (2013.01); *F21W 2131/109* (2013.01); *F21Y 2115/10* (2016.08)

(58) Field of Classification Search

CPC ..... F21S 8/022; F21K 9/1375; F21V 23/026; F21V 15/01; F21V 29/22

See application file for complete search history.

(56) References Cited

U.S. PATENT DOCUMENTS

| | | | | |
|---|---|---|---|---|
| 5,743,622 A * | 4/1998 | Ibbitson | F21S 8/022 362/145 |
| 2011/0127912 A1* | 6/2011 | Lee | H01L 33/647 315/32 |
| 2013/0200796 A1* | 8/2013 | Song | F21V 23/002 315/113 |
| 2014/0119022 A1* | 5/2014 | Beausoleil | F21S 6/004 362/294 |
| 2015/0369469 A1* | 12/2015 | Vamberi | F21S 8/022 362/153.1 |

* cited by examiner

*Primary Examiner* — Anh Mai
*Assistant Examiner* — Matthew Peerce
(74) *Attorney, Agent, or Firm* — Doherty IP Law Group LLC

(57) ABSTRACT

An LED light fixture that replaces a par 36 lamp includes a body casting having an LED mounting area with an outer perimeter surrounded by an outer ring, and a shroud covering a portion of the outer perimeter of the LED mounting area. The body casting has elongated slots that extend between the LED mounting area and the outer ring. The outer ring has internally threaded openings that extend through the outer ring and that are spaced from one another around the outer ring. The light fixture includes ground mounting pins having first ends with external threads that are adapted to mesh with the internally threaded openings in the outer ring. The pins may be affixed for ground mounting and removed for disposing the light fixture in a well housing disposed in the ground. An LED circuit board containing one or more LEDs overlies the LED mounting area.

20 Claims, 14 Drawing Sheets

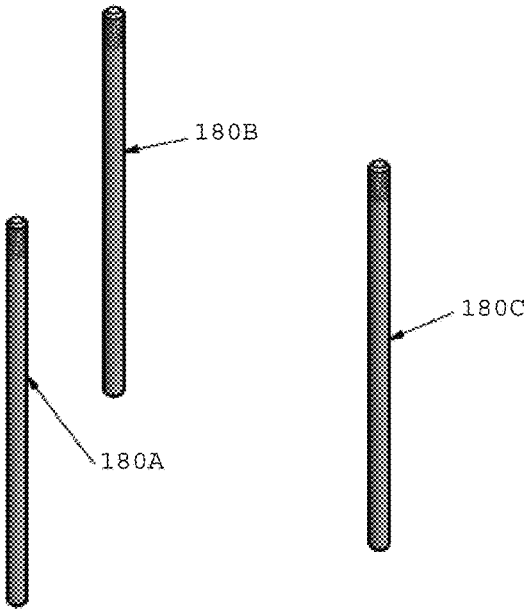
FIG. 9A
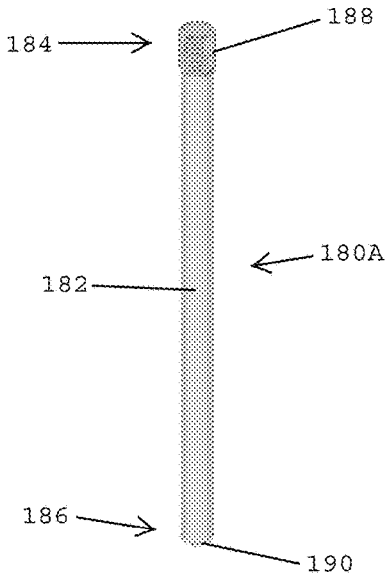
FIG. 9B
FIG. 10
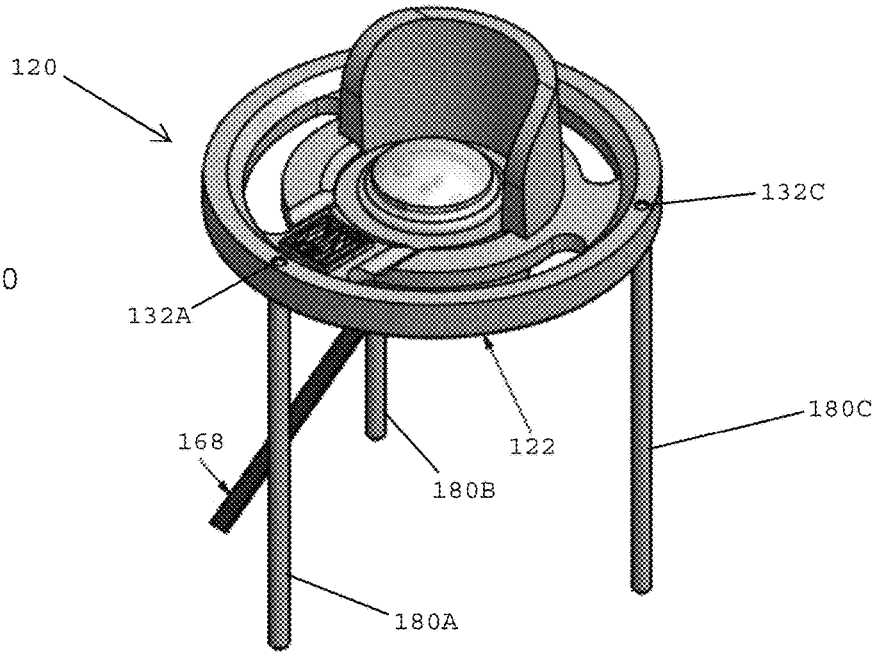

LED LIGHT FIXTURES AND LED LAMPS THAT ARE USED TO REPLACE PAR 36 HALOGEN LAMPS AND INCANDESCENT WELL LIGHTS

CROSS-REFERENCE TO RELATED APPLICATIONS

The present patent application claims benefit of U.S. Provisional Application No. 62/187,384, filed Jul. 1, 2015, the disclosure of which is hereby incorporated by reference herein.

BACKGROUND OF THE INVENTION

Field of the Invention

The present patent application is generally related to landscape lighting and landscape lighting fixtures, and is more specifically related to LED light fixtures and LED lamps that replace Par 36 halogen lamps and incandescent well lights.

Description of the Related Art

Referring to FIG. 1, the history of low voltage landscape lighting would not be complete without paying tribute to the ubiquitous Par 36 Halogen lamps and incandescent well lights. These fixtures, because of the mounting canister and below grade orientation of the lamp face (which produce very wide beam angles that beautifully illuminate low wide plant material), the adjustability of the lamp from 0 horizontal to 22' vertical, and the low cost to the consumer, paved the way for hundreds of thousands of landscape lighting installations all over the United States and Canada. Sealed beam Par 36 lamps are typically manufactured by melting together two pieces of glass and filling the void inside with inert argon gas. This lamp has the added benefit of being moisture-resistant and can withstand being completely submerged under several feet of water. Due to cost, durability and excellent light dissipation, this product makes up a great deal of the total number of low voltage decorative landscape lighting fixtures that are installed and sold.

With the advent of Light Emitting Diode (LED) technology, a need exists to allow installers to retrofit existing halogen and incandescent Par 36 lamps that were originally installed in well light fixtures. LEDs are a better choice to replace these old lamps because of the high wattage consumed by the halogen and incandescent lamps (typically 35 to 20 watts), the relatively short lamp life of between 2,000 to 5,000 hours, and the labor required to maintain these systems. Referring to FIG. 2, most LED replacement lamp manufacturers have chosen to use the same legacy par 36 halogen dimensional lamp size when designing these LED replacements. In fact the majority of the LED par 36 lamps look strikingly similar to the Par 36 halogen lamps they replace. As a result, these Par 36 replacement LED lamps must be installed in a plastic housing and snap-fit into an accompanying gimbal ring in order to operate properly. Simply attaching the fork connector to the brass screw terminal and laying the LED lamp on the ground is not acceptable, is subject to damage, and would not be approved by UL since this is not in line with the intended use of the lamp as being part of a complete fixture.

Thus, there remains a need for improved LED light fixtures and LED lamps that replace Par 36 halogen lamps and incandescent well lights.

SUMMARY OF THE INVENTION

The present patent application discloses an all in one LED Par 36 Halogen replacement Lamp/in-ground well light fixture, which is dubbed the DYNAMIC DUO.

In one embodiment, the LED light fixture disclosed herein may function as a stand-alone fixture or a replacement lamp for a Par 36 halogen lamp that would traditionally be in a well housing with an accompanying gimbal ring to hold and position the Par 36 lamp.

For use as a replacement to a Par 36 lamp, the electrical connection would use a waterproof crimp or wire nut connection as opposed to the fork and terminal screw used in the old Par 36 halogen lamp connections. To use the fixture as a stand-alone well light that does not require a well housing or gimbal ring, an installer may attach the three pins into the tapped holes made in the outer ring of a fixture body casting. In one embodiment, the three pins simply press into the soil directly under the object requiring illumination in the landscape. This feature allows for easy installation, removal, repositioning, and can be angled off 90' to direct the light where required. In one embodiment, the entire fixture is fully potted and moisture resistant.

In one embodiment, the outer diameter of the body casting is equal to that of a Par 36 halogen lamp (e.g., outer diameter of 4.25" and thickness of 0.435"), making it suitable for snapping into any fixture designed to fit a Par 36 lamp.

In one embodiment, the body casting includes heat dissipating vent holes/dirt passage ways/water passage ways to channel water off the lens atop the body casting that surround the central core of the body casting that contains the LED driver and the LEDs.

In one embodiment, the outer ring of the body casting acts as a grass and plant material barrier to help keep grass away from the central optic. The outer ring desirably deflects plant material.

In one embodiment, a landscape lighting fixture includes ground mount pins. The pins desirably do not come to a point, which could pose a hazard should an individual fall on a light fixture during installation. In one embodiment, the pins have a dull slightly chamfered edge.

In one embodiment, the ground mount pins are made of metal such as stainless steel.

In one embodiment, the glass lens directly over the optic is molded convex borosilicate glass that does not collect standing water over the optic so as to minimize light depletion due to calcium from sprinkler water or general debris collecting on the glass.

In one embodiment, the LED driver is fully potted so that no moisture will enter either the driver cavity or LED area to prevent corrosion to the fixture.

These and other preferred embodiments of the present invention will be described in more detail below.

BRIEF DESCRIPTION OF THE DRAWINGS

FIGS. 9A and 9B show ground mounting pins for a replacement LED light fixture, in accordance with one embodiment of the present invention.

FIG. 10 shows a perspective view of a replacement LED light fixture, in accordance with one embodiment of the invention.

DETAILED DESCRIPTION

Figure 1:
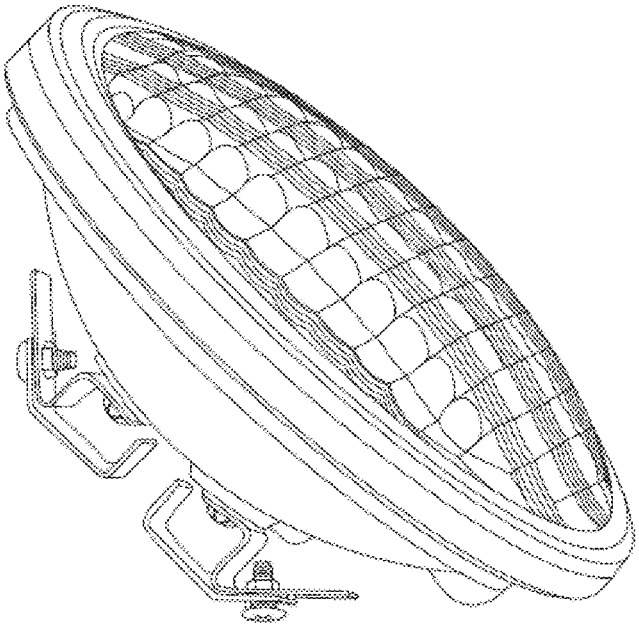
FIG. 1 PRIOR ART
FIG. 1 shows a prior art Par 36 lamp.
Figure 2:
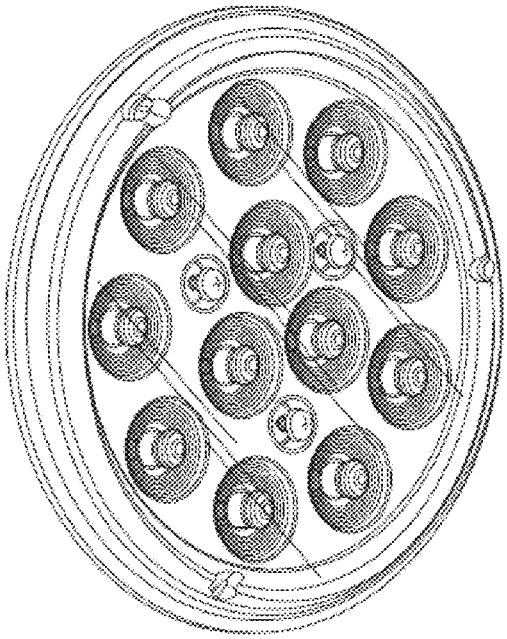
FIG. 2 PRIOR ART
FIG. 2 shows a prior art Par 36 lamp incorporating LED technology.
Figure 3:
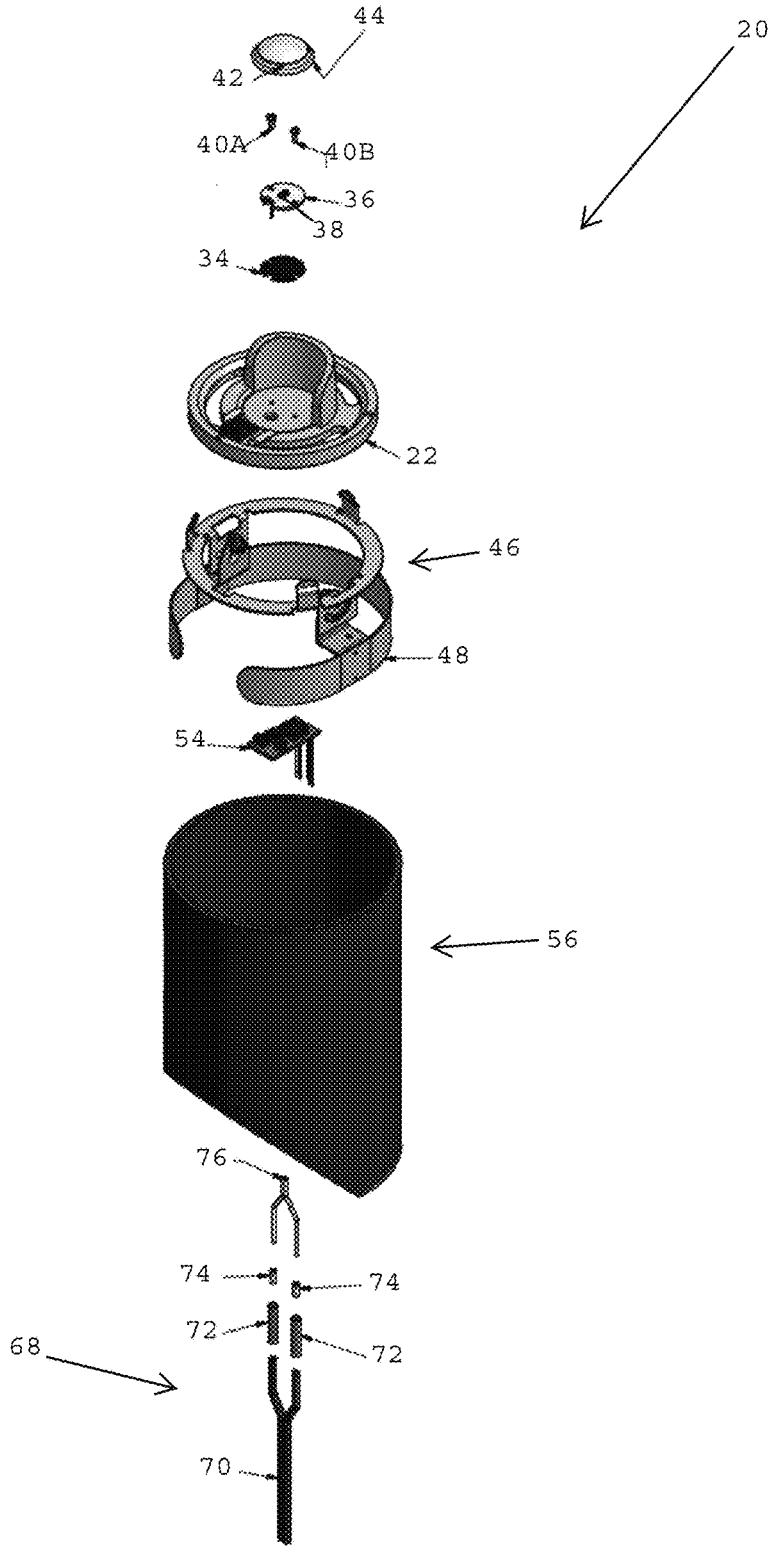
FIG. 3 shows an exploded view of a replacement LED light fixture, in accordance with one embodiment of the present invention.
Figure 4:
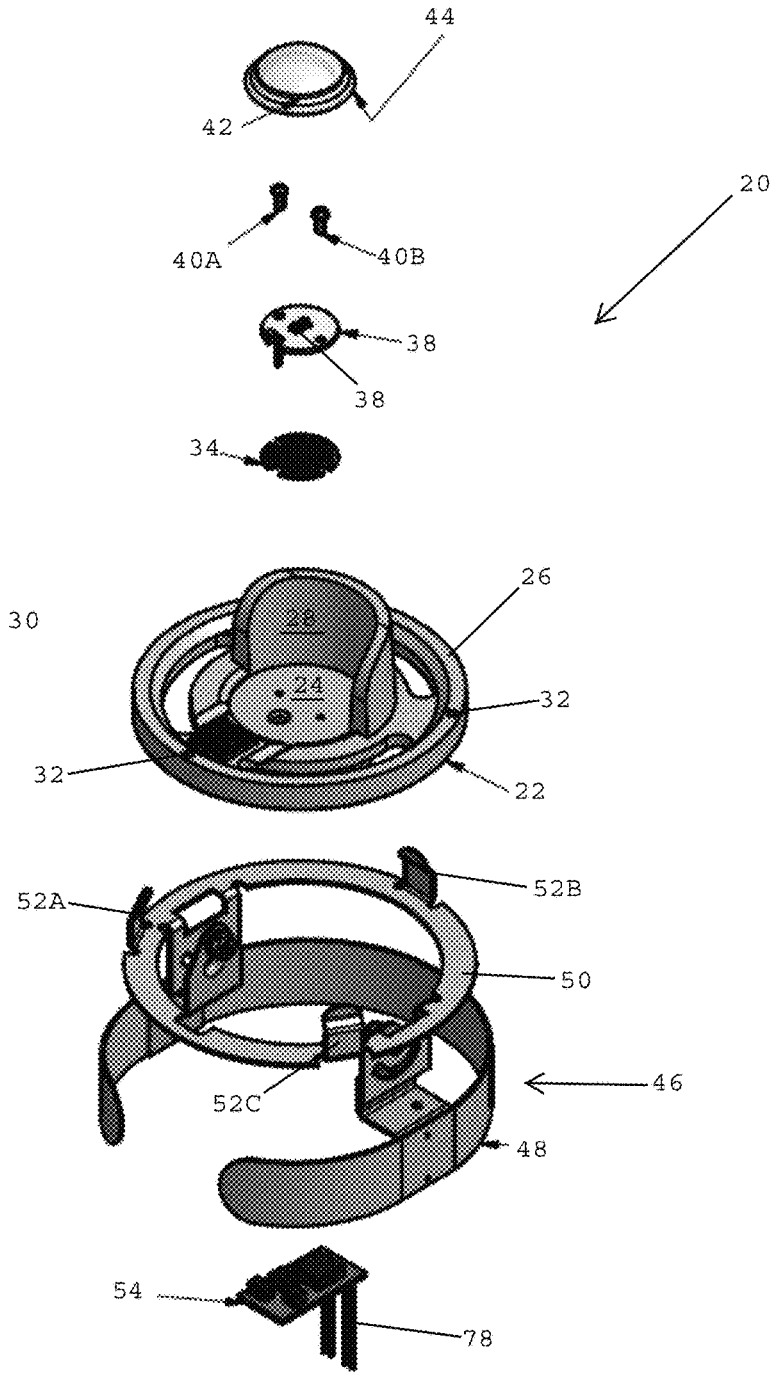
FIG. 4 shows an exploded view of an upper portion of the replacement LED light fixture shown in FIG. 3.

Referring to FIGS. 3 and 4, in one embodiment, a replacement LED light fixture 20 includes a body casting 22 having an LED mounting area 24 surrounded by an outer ring 26. A shroud 28 covers a portion of the outer perimeter of the LED mounting area 24 for shielding light generated by an LED as will be described in more detail herein. In one embodiment, the shroud 28 is permanently affixed to the body casting 22. In one embodiment, the body casting and the shroud are formed as one piece.

In one embodiment, the body casting 22 includes elongated slots 30 that extend between the LED mounting area 24 and the outer ring 26. The elongated slots 30 may function as drainage slots for allowing water and moisture to drain away from the LED mounting area 24 and through the body casting 22. The elongated slots 30 may also function as heat vents for enabling heat to escape from the light fixture, particularly in instances in which the LED light fixture is disposed inside a well housing. The elongated slots may function as both drainage slots and heat vents. In one embodiment, the body casting 22 has threaded openings 32 that extend through the outer ring 26. The threaded openings 32 are adapted to receive the outer threads on a ground mounting pin, as will be described in more detail herein.

In one embodiment, the replacement LED light fixture 20 includes a thermally conductive pad 34 adapted to sit atop the LED mounting area 24, an LED circuit board 36 containing one or more LEDs 38, and fasteners 40A, 40B for securing the LED circuit board 36 and the thermally conductive pad 34 atop the LED mounting area 24 of the body casting 22.

In one embodiment, the replacement LED light fixture 20 includes a lens 42, such as a glass lens, having an outer attachment ring 44, which is adapted to cover the LED circuit board 36. In one embodiment, the lens 42 is sealed to the LED mounting area 24 of the body casting 22 using silicone, such as RTV silicone.

In one embodiment, the replacement LED light fixture 20 includes a bracket 46 having a lower end including a friction ring 48 and an upper end including an attachment ring 50 having spaced prongs 52A-52C. In one embodiment, the body casting 22 is secured to the bracket 46 by passing the outer ring 26 of the body casting between the prongs 52A-52C of the bracket 46. The prongs 52A-52C are normally biased inwardly for pressing against the outer perimeter of the outer ring 26 of the body casting 22 for generating a friction fit between the body casting and the bracket 46.

In one embodiment, the replacement LED light fixture 20 includes an LED driver 54 having one or more microprocessors for controlling operation of the LEDs 38 on the LED board 36.

Figure 5:
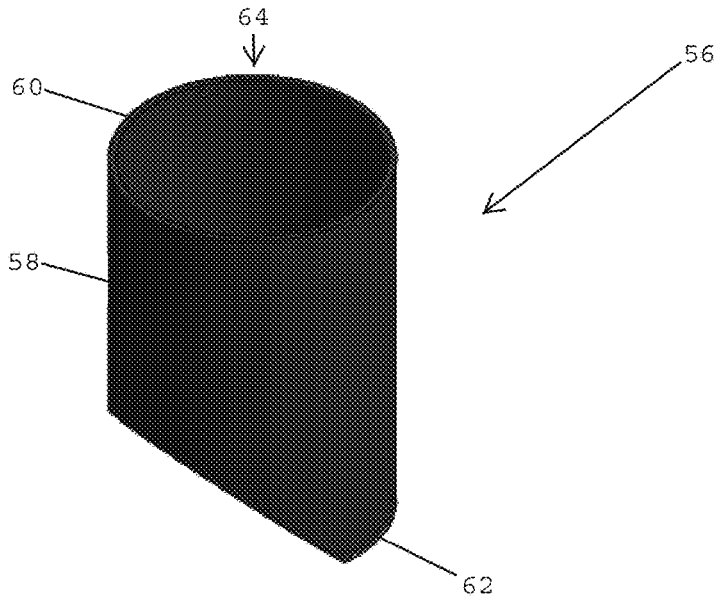
FIG. 5 shows a well housing for the replacement LED light fixture shown in FIGS. 3 and 4.

Referring to FIGS. 3 and 5, in one embodiment, the replacement LED light fixture 20 preferably includes a well housing 56 having a cylindrical shaped outer wall 58 with an upper end 60 and a lower end 62. The well housing may be made of durable materials such as plastic or metal. The outer wall 58 of the well housing 56 defines a central opening 64 that extends between the upper end 60 and the lower end 62. The central opening is adapted to receive the bracket 46 and the body casting 22. In one embodiment, the well housing 56 includes an angled cut 66 formed in the outer wall 58 that slopes toward the lower end 62. In one embodiment, the angled cut 66 defines an angle of about 30-60 degrees and more preferably about 45 degrees.

Referring to FIG. 3, in one embodiment, the replacement LED light fixture 20 includes conductive wiring 68 for providing power to the LED driver 54 and the LED circuit board 36. In one embodiment, the conductive wiring 68 includes lead wire 70, such as tin-coated lead wire, heat shrink film 72, and crimps 74, such as non-insulated parallel crimps. An upper end 76 of the conductive wire 68 is electrically interconnected with leads 78 of the LED driver 54.

Referring to FIGS. 3-6, in one embodiment, in order to assemble the replacement LED light fixture 20, the bracket 46 is inserted into the well housing 56 so that the friction ring 48 engages the inner surface of the outer wall 58 of the well housing to form a friction fit between the bracket 46 and the well housing 56. The body casting 22 is secured to the attachment ring 50 of the bracket 46 by juxtaposing the outer ring 26 of the body casting 22 with the prongs 52A-52C and inserting the outer ring between the prongs of the body casting 22. The prongs are normally biased inwardly for engaging the outer perimeter of the outer ring. Electrical connections are desirably formed between the upper end 76 of the conductive wire 68 and the leads 78 of the LED driver 54.

Figure 6:
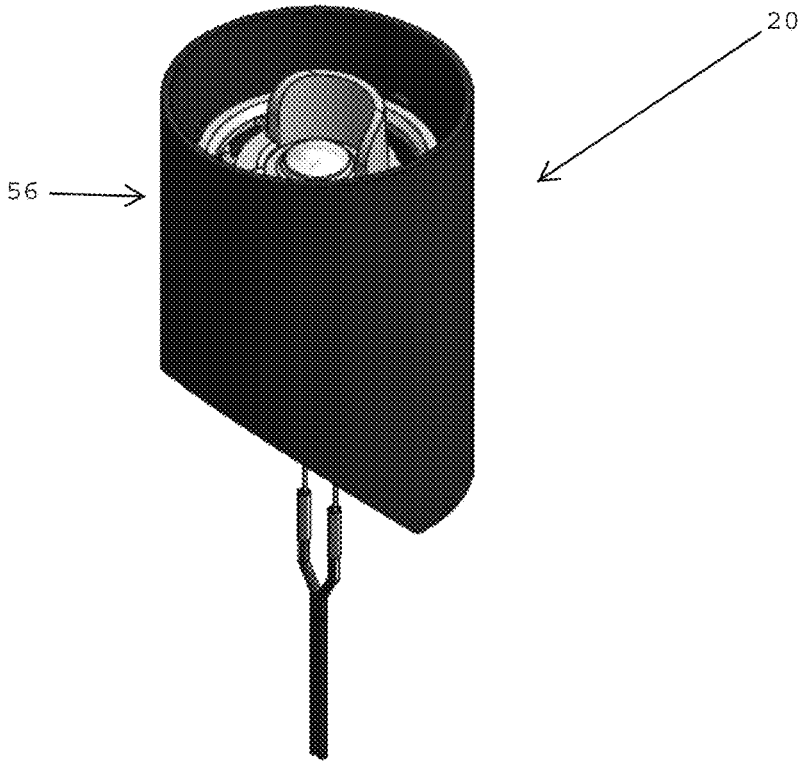
FIG. 6 shows the assembled replacement LED light fixture of FIG. 3.
Figure 7:
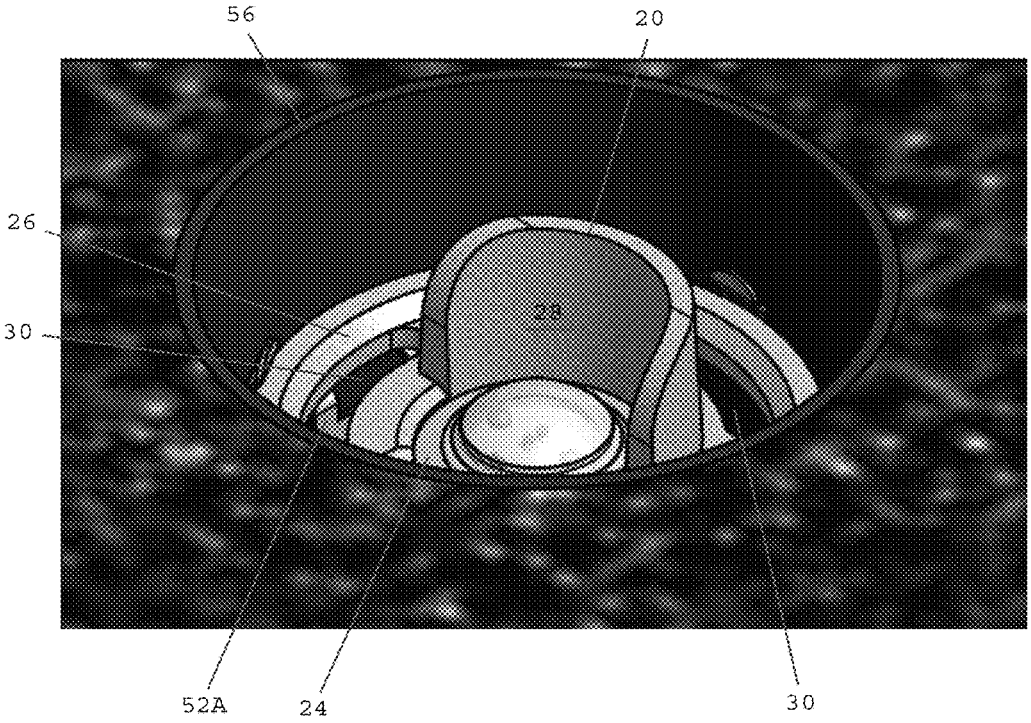
FIG. 7 shows the replacement LED light fixture of FIG. 6 inserted into the ground.

Referring to FIGS. 6 and 7, the fully assembled replacement LED light fixture 20 may be inserted into the ground. In one embodiment, the well housing 56 was previously inserted into the ground for containing a Par 36 halogen lamp or incandescent bulb. The replacement LED light fixture 20 disclosed herein replaces the existing Par 36 halogen lamp or incandescent bulb. The orientation of the shroud 28 relative to the bracket 46 (FIG. 4) may be adjusted by rotating the outer ring 26 relative to the prongs 52A-52C (FIG. 4) previously disposed within the well housing 56. Thus, the shroud 28 may be oriented in any direction for directing the light generated by the one or more LEDs. The elongated slots 30 surrounding the LED mounting area 24 enable heat generated by the LEDs to be vented from the light fixture 20. The elongated slots 30 also enable moisture, rain, and/or water to be drained away from the LED mounting area 24.

Figure 8A:
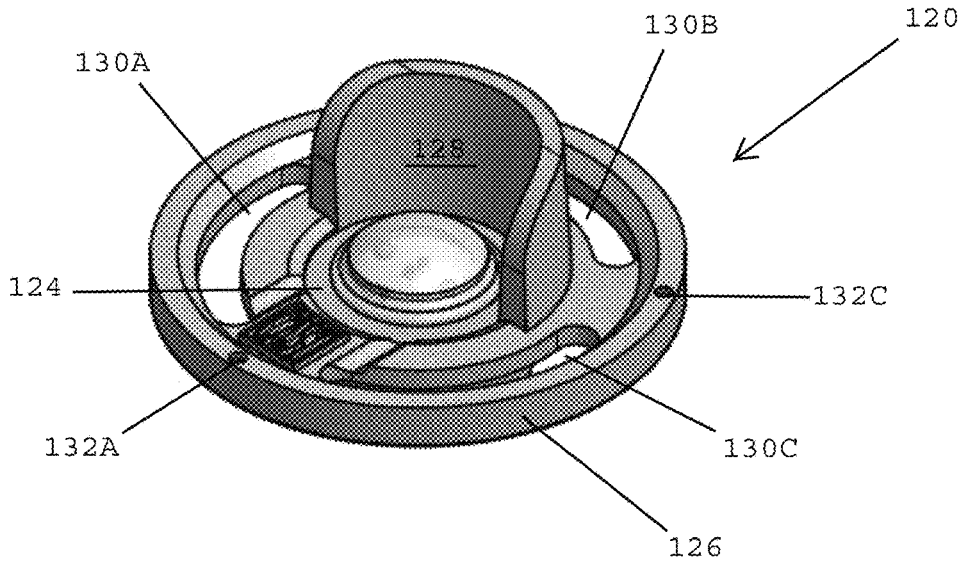
FIG. 8A shows a perspective view of a body casting for a replacement LED light fixture, in accordance with one embodiment of the present invention.
Figure 8B:
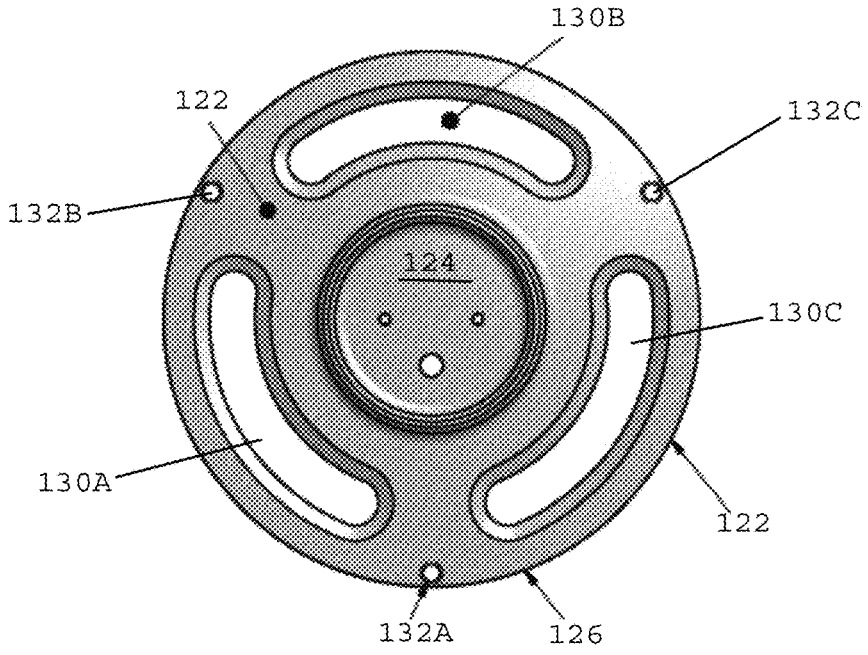
FIG. 8B shows a top plan view of a body casting for a replacement LED light fixture, in accordance with one embodiment of the present invention.

In one embodiment, a replacement LED light fixture may be installed directly into the ground without using a well housing. Referring to FIGS. 8A and 8B, a replacement LED light fixture 120 includes all of the elements described above and shown in FIGS. 3 and 4. In one embodiment, the replacement LED light fixture 120 includes a body casting 122 having an LED mounting area 124 surrounded by an outer ring 126. A shroud 128 covers a portion of the outer perimeter of the LED mounting area 124 for shielding light generated by one or more LEDs positioned atop the LED mounting area 124. For clarity, the shroud 128 is not shown in FIG. 8B. The body casting 122 includes elongated slots 130, such as elongated, arc shaped drainage slots, which extend between the LED mounting area 124 and the outer ring 126 for allowing water and moisture to drain away from the LED mounting area 124 and through the body casting 122. The elongated slots may also function as heat vents for dissipating heat generated by the LED light. In one embodiment, the body casting 122 has threaded openings 132A-132C that extend through the outer ring 126 (e.g., from the top surface to the bottom surface). The threaded openings 132A-132C are adapted to receive the outer threads on ground mounting pins, as will be described in more detail herein.

Referring to FIG. 9A, in one embodiment, the replacement LED light fixture 120 (FIG. 8A) includes a set of ground mounting pins 180A-180C that are adapted to be threaded into the threaded openings 132A-132C extending through the outer ring 126 (FIG. 8B). In one embodiment, three ground mounting pins are used. In one embodiment, three to six ground mounting pins may be used. Referring to FIG. 9B, in one embodiment, the first ground mounting pin 180A has a shaft 182 that extends from an upper end 184 to a lower end 186. The shaft may have a length of about 3-4 inches and more preferably about 3.5 inches. The upper end 184 of the shaft 182 has external threads 188 that are adapted to mesh with the internally threaded openings 132A-132C of the body casting 122 (FIG. 8B). In one embodiment, the threaded section has a length of about 0.200-0.300 inches and more preferably about 0.250 inches. In one embodiment, the lower end 186 of the shaft 182 has a chamfered surface 190 for facilitating insertion of the lower end 186 into the ground.

Figure 11A:
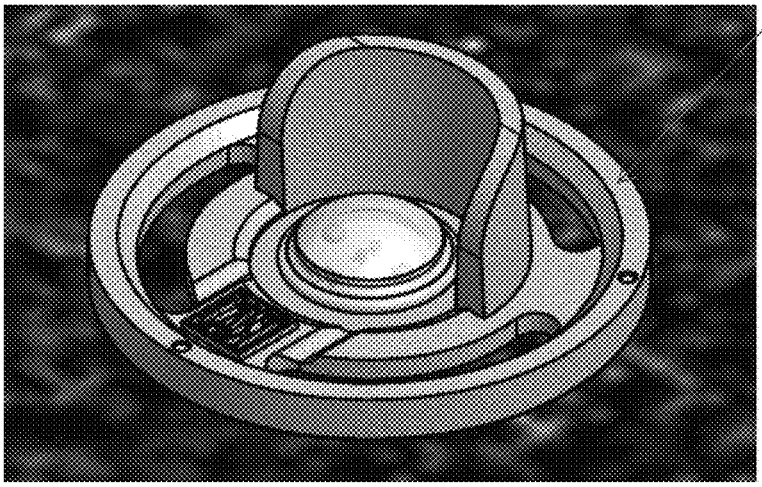
FIGS. 11A and 11B show the replacement LED light fixture of FIG. 10 inserted into the ground.
Figure 11B:
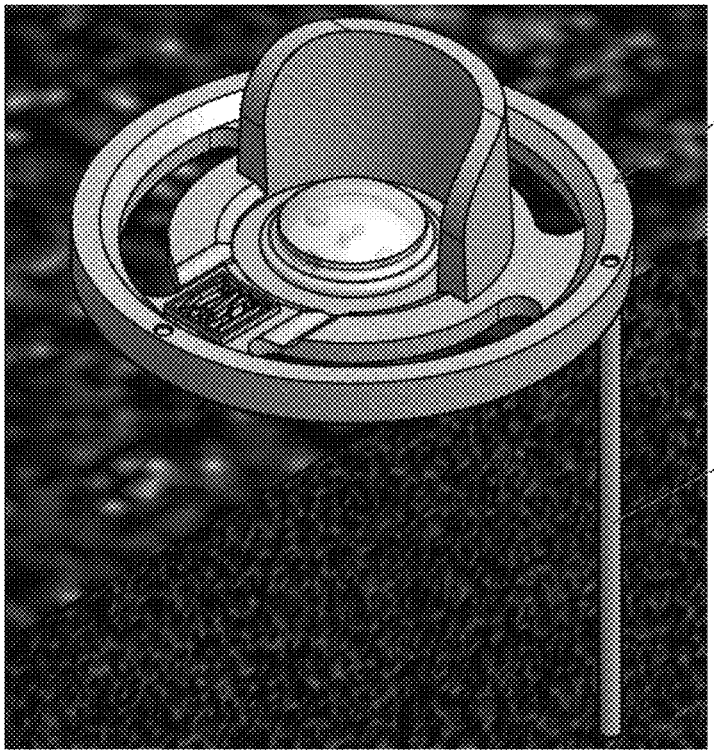

FIG. 10 shows the ground mounting pins 180A-180C threaded into the internally threaded openings 132A-132C (FIG. 8B) of the body casting 122. Power may be supplied to the LED light fixture by connecting conductive wiring 168 with the light fixture. Referring to FIGS. 11A and 11B, the LED light fixture 120 may be inserted into the ground by pushing the lower ends of the respective pins 180A-180C (FIG. 10) into the ground. For clarity, in FIG. 11B, only the third ground mounting pin 180C is shown.

Unlike knuckle mounted lights and spot-lights, the body casting disclosed herein is able to be positioned closer to the ground and positioned at grade, which enables an increase in beam spread and better light cover. When using knuckle mounted fixtures, the light emitting portion of the fixture tends to be about six inches off the ground, which decreases the beam spread. By being positionable at grade, the light emitting portion of the LED light fixture disclosed herein is closer to the ground or grade, which provides the benefits disclosed above.

Figure 12:
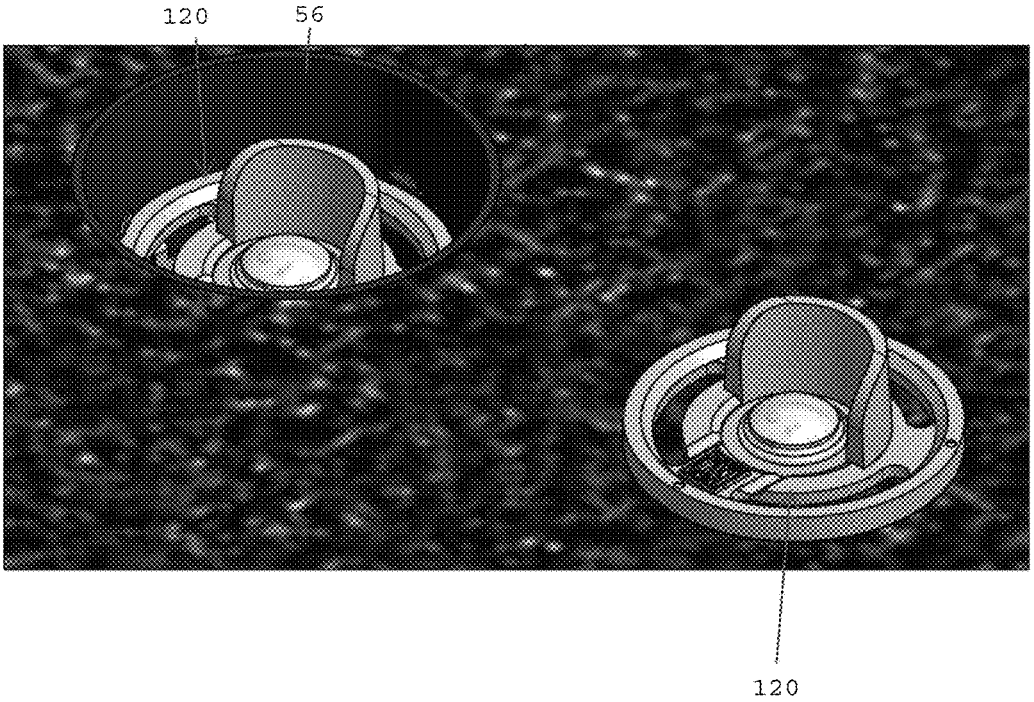
FIG. 12 shows the replacement LED light fixture of FIG. 7 and the replacement LED light fixture of FIG. 10 inserted into the ground.

In one embodiment, the ground mounting pins may be permanently secured to the body casting. Referring to FIG. 12, in one embodiment, the ground mounting pins may be removed from the body casting so that the replacement LED light fixture 120 may be used with the well housing 56 described above and shown in FIGS. 3-6. In one embodiment, the LED light fixture 120 may be used without the well housing for direct insertion into the ground as described above and shown in FIGS. 10 and 11A-11B.

Figure 13A:
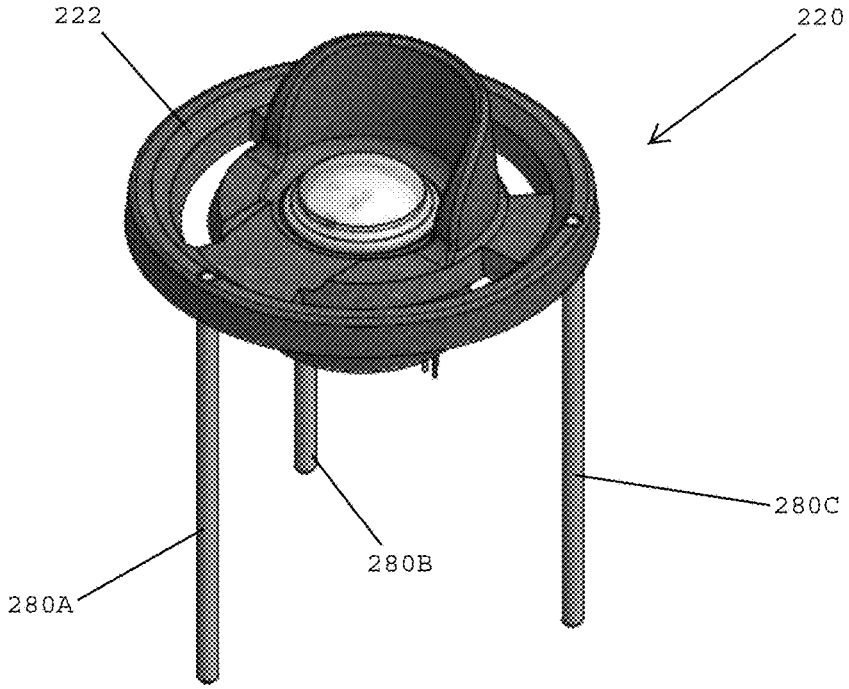
FIGS. 13A-13E show a replacement LED light fixture, in accordance with one embodiment of the invention.
Figure 13B:
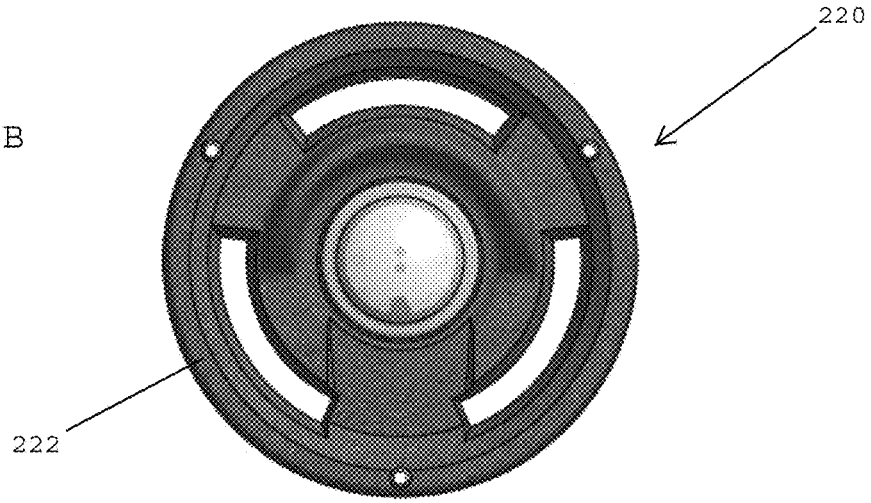

Referring to FIGS. 13A-13E, in one embodiment, an LED light fixture 220 has one or more of the components described herein. In one embodiment, the LED light fixture 220 has ground anchoring pins 280A-280C that are permanently affixed to the body casting 222. In one embodiment, the ground anchoring pins 280A-280C may be detached from the body casting 222. FIG. 13A shows the LED light fixture with the pins installed in the body casting 222. FIG. 13B shows the LED light fixture with the pins removed from the body casting 222.

Figure 13C:
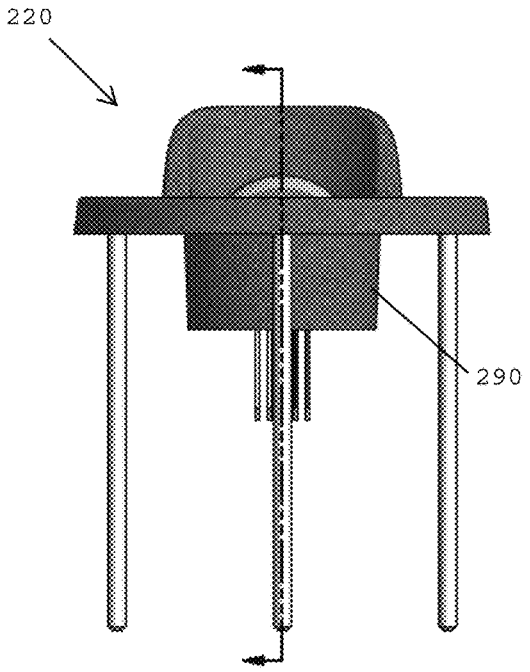
Figure 13D:
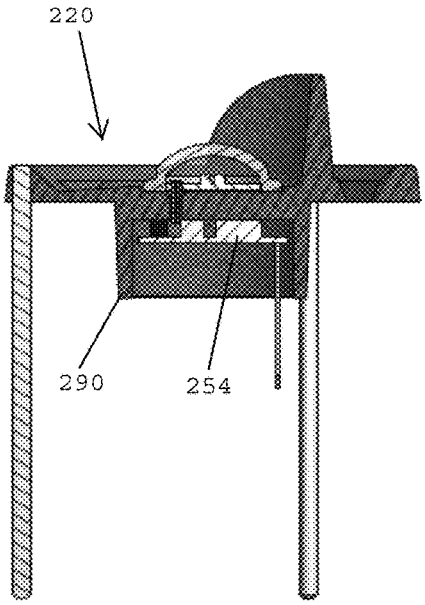
Figure 13E:
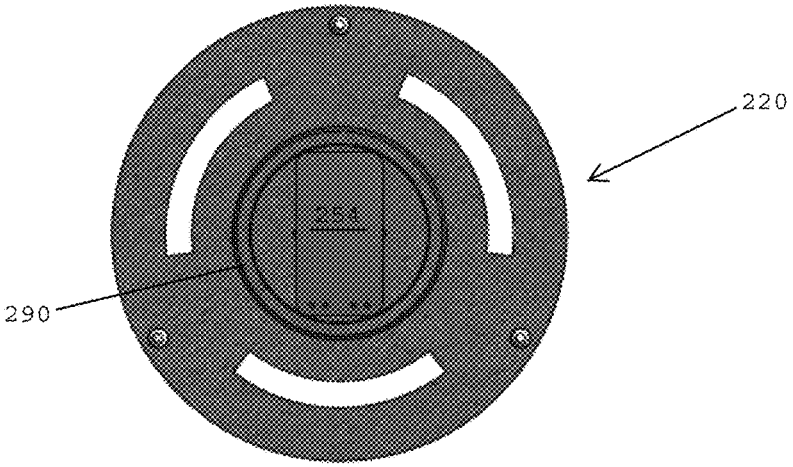

Referring to FIGS. 13C-13E, in one embodiment, the body casting 222 includes a mounting flange 290 that projects from the bottom of the body casting. The LED driver 254 is disposed within the mounting flange 290. The LED driver may be potted. The conductive wire(s) 278 for the LED driver 254 may extend through a central opening that is surrounded by the mounting flange 290. In one embodiment, the mounting flange 290 has a circular or ring shaped cross-section.

Figure 14A:
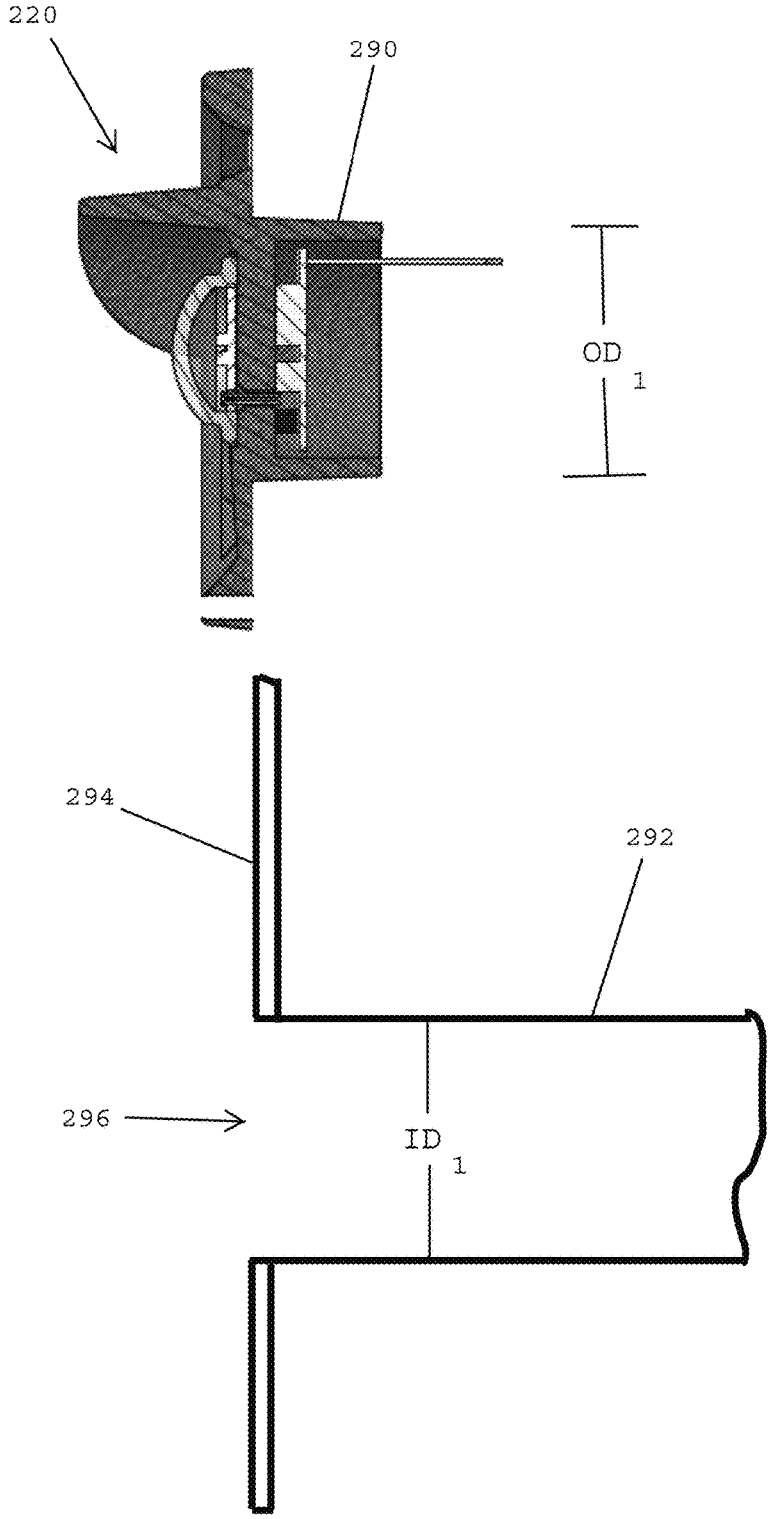
FIGS. 14A and 14B show a method of installing a replacement LED light fixture, in accordance with one embodiment of the present invention.

Referring to FIG. 14A, in one embodiment, the LED light fixture may be used in conjunction with PVC pipe 292. In FIG. 14A, the PVC pipe 292 is inserted into a wall 294 having a wall opening 296. The PVC pipe 292 has an inner diameter $ID_1$ that closely matches the outer diameter $OD_1$ of the mounting flange 290 of the LED light fixture 220. In one embodiment, the outer diameter of the mounting flange 290 is about 2 inches and the inner diameter of the PVC pipe 292 is about 2 inches. Other diameters may be used as long as the outer diameter of the mounting flange 290 generally matches the inner diameter of the PVC pipe 292. Electrical wiring is desirably passed through the PVC pipe for providing power to one of more LED light fixtures. In one embodiment, conduit may be used in place of the PVC pipe.

Figure 14B:
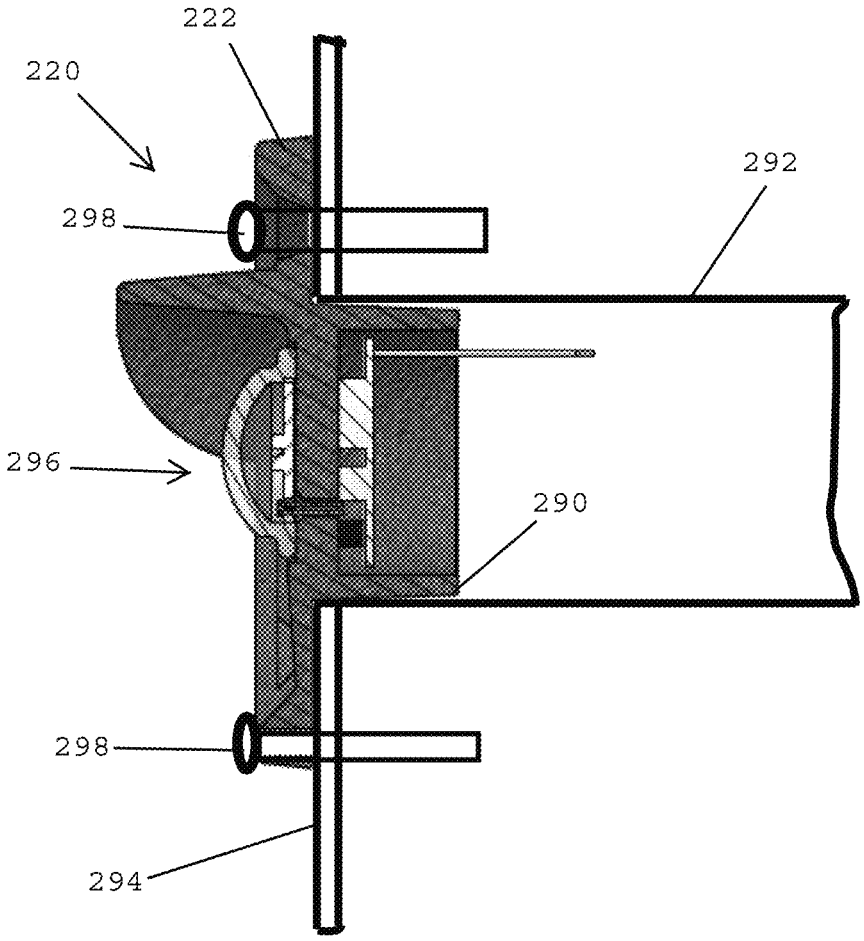

Referring to FIG. 14B, in one embodiment, the mounting flange 290 is inserted into the wall opening 296 (FIG. 14A) and into the PVC pipe 292. The outer surface of the mounting flange 290 desirably forms a friction fit with the inner surface of the PVC pipe 292 for securing the LED light fixture 220 to the wall 294 and with the PVC pipe 292. Fasteners 298 may be passed through the threaded openings in the body casting 222 and into the wall 294 for further securing the LED light fixture 220 to the wall 294.

Figure 15:
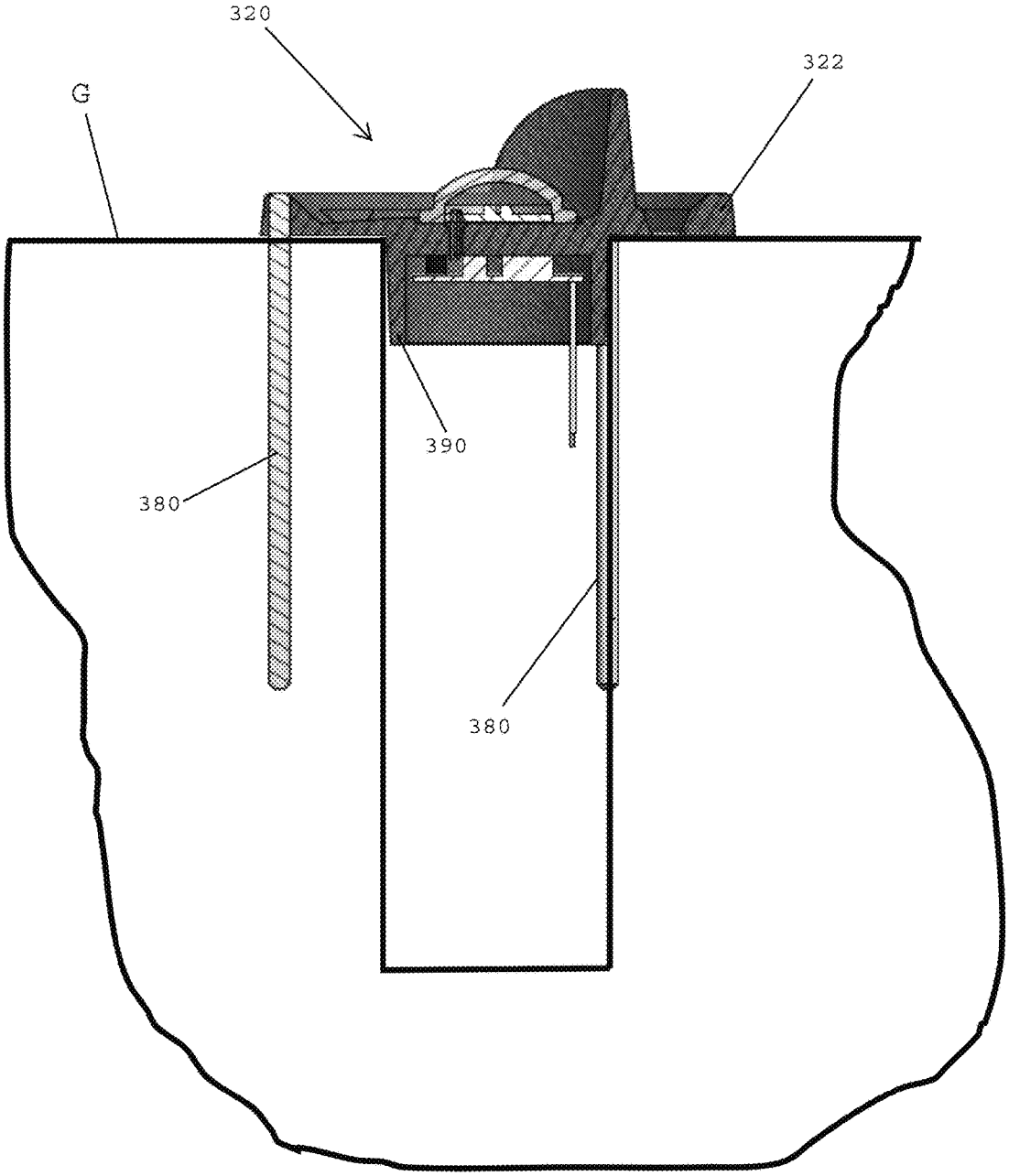
FIG. 15 shows a replacement LED light fixture, in accordance with one embodiment of the present invention.

Referring to FIG. 15, in one embodiment, a mounting flange 390 of an LED light fixture 320 is inserted into PVC pipe 392 that, in turn, is disposed in the ground G. The PVC pipe may also be disposed in poured concrete or between paving stones, with the open upper end of the PVC pipe being accessible for inserting an LED light fixture inside the open, accessible end of the PVC pipe. The outer surface of the mounting flange 390 desirably forms a friction fit with the inner surface of the PVC pipe 292 for securing the LED light fixture 220 to the PVC pipe 292. Ground mounting pins 380 may be secured to the body casting 322 for further securing the LED light fixture 320 in place on the ground. In one embodiment, a series of PVC pipes may be aligned on each lateral side of a driveway or walkway and LED light fixtures (as disclosed herein) may be inserted into each of the respective PVC pipes.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. An LED light fixture comprising:

a body casting having an LED mounting area having an outer perimeter surrounded by an outer ring;

a shroud covering a portion of the outer perimeter of said LED mounting area and projecting away from a top surface of said LED mounting area;

said body casting having elongated slots that extend between said LED mounting area and said outer ring;

said outer ring having internally threaded openings that extend through said outer ring and that are spaced from one another around said outer ring;

ground mounting pins having upper ends having external threads that mesh with said internally threaded openings in said outer ring for securing said ground mounting pins to said outer ring, wherein said ground mounting pins extend from a bottom surface of said outer ring in a direction opposite the top surface of said LED mounting area and have lower ends that are spaced from the bottom surface of said outer ring for defining a lower-most end of said LED light fixture.

2. The LED light fixture as claimed in claim 1, further comprising:

a thermally conductive pad overlying the top surface of said LED mounting area;

an LED circuit board containing one or more LEDs overlying said thermally conductive pad;

one or more fasteners extending through said LED circuit board for securing said LED circuit board and said thermally conductive pad atop the top surface of said LED mounting area.

3. The LED light fixture as claimed in claim 2, further comprising an LED driver having one or more microprocessors for controlling operation of said one or more LEDs on said LED circuit board.

4. The LED light fixture as claimed in claim 3, further comprising a lens having a lens attachment ring affixed to the top surface of said LED mounting area and overlying said LED circuit board.

5. The LED light fixture as claimed in claim 4, wherein said lens comprises glass.

6. The LED light fixture as claimed in claim 2, wherein said elongated slots are heat vents for venting heat generated by said one or more LEDs.

7. The LED light fixture as claimed in claim 4, further comprising silicone sealing said lens attachment ring to the top surface of said LED mounting area.

8. The LED light fixture as claimed in claim 1, wherein said elongated slots are elongated, arc shaped drainage slots extending between an outer perimeter of said LED mounting area and an inner perimeter of said outer ring for allowing water and moisture to drain away from said LED mounting area and through said body casting.

9. The LED light fixture as claimed in claim 1, wherein said shroud has a lower end that is affixed to the top surface of said LED mounting area and an upper end that projects away from the top surface of said LED mounting area, wherein said body casting and said shroud are formed as one piece.

10. The LED light fixture as claimed in claim 1, further comprising:

a bracket having a lower end including a friction ring;

said bracket having an upper end including an attachment ring having spaced prongs that are normally biased inwardly, wherein said outer ring of said body casting is disposed between said spaced prongs for securing said body casting to said bracket.

11. The LED light fixture as claimed in claim 10, further comprising a well housing having an outer wall with an upper end and a lower end, wherein said well housing defines a central opening that extends between said upper end and said lower end thereof, and wherein said bracket and said body casting are disposed within the central opening of said well housing.

12. The LED light fixture as claimed in claim 11, wherein said well housing is made of a material selected from the group consisting of plastic and metal.

13. The LED light fixture as claimed in claim 12, further comprising conductive wiring for providing power to said LED driver and said LED circuit board.

14. A method of assembling said LED light fixture as claimed in claim 13 comprising:

inserting said bracket into said well housing so that said friction ring engages an inner surface of said outer wall of said well housing to form a friction fit between said bracket and said well housing;

securing said body casting to said attachment ring of said bracket by juxtaposing said outer ring of said body casting with said spaced prongs and inserting said outer ring between said spaced prongs of said body casting, wherein said spaced prongs engage the outer perimeter of said outer ring; and electrically connecting said conductive wire and said LED driver.

15. The method as claimed in claim 14, further comprising adjusting the orientation of said shroud relative to said bracket by rotating said outer ring relative to said spaced prongs disposed within said well housing for directing light generated by said one of more LEDs in a selected direction.

16. The method as claimed in claim 15, further comprising detaching said ground mounting pins from said body casting prior to inserting said body casting into said well housing.

17. The method as claimed in claim 16, further comprising installing said LED light fixture directly into the ground by securing said ground mounting pins to said body casting so that said pins project from a bottom surface of said body casting and advancing free ends of said ground mounting pins into the ground.

18. An LED light fixture comprising:

a body casting comprising an LED mounting area having a top surface and an outer perimeter, an outer ring surrounding the outer perimeter of said LED mounting area, and elongated, arc shaped drainage slots extending between the outer perimeter of said LED mounting area and an inner perimeter of said outer ring for allowing water and moisture to drain away from said LED mounting area and through said body casting;

an LED circuit board including one or more LEDs secured to the top surface of said LED mounting area;

a lens secured to the top surface of said LED mounting area and covering said LED circuit board;

a shroud affixed to the top surface of said LED mounting area and projecting away from the top surface of said LED mounting area;

ground mounting pins having upper ends secured to said outer ring, lengths that extend away from a bottom surface of said outer ring in a direction opposite the top surface of said LED mounting area, and lower ends that are spaced from the bottom surface of said outer ring for defining a lower-most end of said LED light fixture.

19. The LED light fixture as claimed in claim 18, wherein said shroud covers only a portion of the outer perimeter of said LED circuit board for directing light generated by said one or more LEDs in a selected direction.

20. An LED light fixture comprising:

a body casting comprising an LED mounting area having a top surface and an outer perimeter, an outer ring surrounding the outer perimeter of said LED mounting area, and elongated slots extending between the outer perimeter of said LED mounting area and an inner perimeter of said outer ring for allowing moisture to drain away from said LED mounting area and through said body casting;

a thermally conductive pad overlying the top surface of said LED mounting area;

an LED circuit board containing one or more LEDs overlying said thermally conductive pad and being secured to said body casting;

an LED driver having one or more microprocessors for controlling operation of said one or more LEDs on said LED circuit board;

a lens secured to the top surface of said LED mounting area and covering said LED circuit board;

a shroud having a lower end affixed to the said LED mounting area and an upper end that projects away from the top surface of said LED, wherein the lower end of said shroud extends between an outer perimeter of said lens and the outer perimeter of said LED mounting area;

said outer ring of said body casting having internally threaded openings that extend through said outer ring and that are spaced from one another around said outer ring;

ground mounting pins having upper ends secured to said outer ring and lower ends that are spaced from a bottom surface of said outer ring for defining a lower-most end of said LED light fixture, wherein said ground mounting pins extend away from the bottom surface of said outer ring in a direction opposite the top surface of said LED mounting area.

* * * * *